US005199775A

United States Patent [19]

Morgan et al.

[11] Patent Number: 5,199,775

[45] Date of Patent: Apr. 6, 1993

[54] MODULAR EXHIBITRY UNIT

[75] Inventors: Micky T. Morgan, Princeton; Bernard J. Ernst, Florham Park, both of N.J.

[73] Assignee: The Corporate Communications Group, Inc., Princeton, N.J.

[21] Appl. No.: 617,137

[22] Filed: Nov. 23, 1990

[51] Int. Cl.[5] ..... A47B 47/03

[52] U.S. Cl. ..... 312/257.1; 312/111

[58] Field of Search ..... 312/263, 257.1, 245, 312/140, 107, 111

[56] References Cited

U.S. PATENT DOCUMENTS

| | | | |
|---|---|---|---|
| 1,190,170 | 7/1916 | Hormes | 312/107 |
| 1,245,918 | 11/1917 | Himmel | 312/107 |
| 2,108,516 | 2/1938 | Thompson | 312/107 |
| 2,999,599 | 9/1961 | Jentzen | 312/245 X |
| 3,948,581 | 4/1976 | Helman et al. | 312/245 X |
| 4,116,509 | 9/1978 | Smith | 312/107 |

FOREIGN PATENT DOCUMENTS

| | | | |
|---|---|---|---|
| 414972 | 6/1966 | Switzerland | 312/245 |

*Primary Examiner*—Peter R. Brown

*Attorney, Agent, or Firm*—Oliff & Berridge

[57] ABSTRACT

A portable, disassembleable exhibiting unit is disclosed. The unit has a base for supporting frames in spaced, parallel position. Joining elements join the tops of the frames together to form an open, rigid support core for supporting relatively heavy furniture units and accessories. Securing elements are mounted on the frames and cooperate with receiving elements on the units to be mounted on the core to hold the units on the core. Units mounted adjacent the base are configured to interfit with the base and extend outwardly and engage a support surfaces to provide additional stability. Locking plates are provided on the base to interlock with adjacent bases.

17 Claims, 4 Drawing Sheets

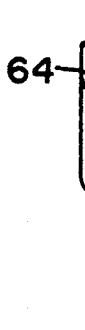
Fig - 6
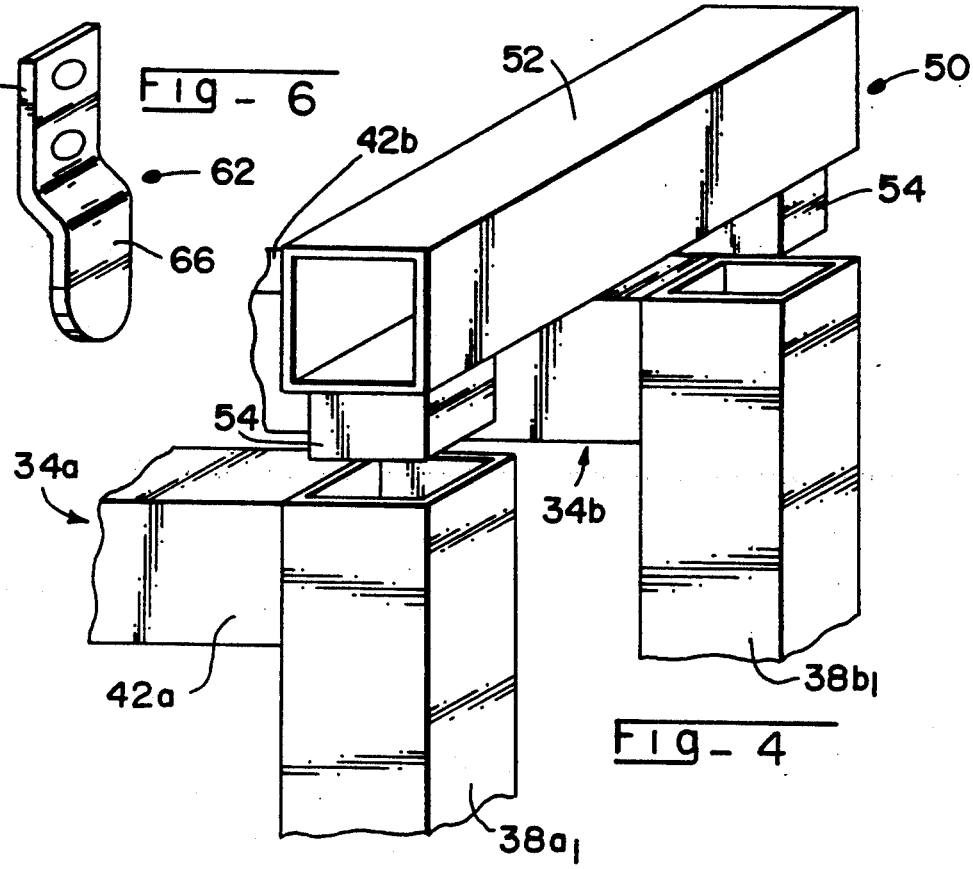
Fig - 4
Fig - 4a
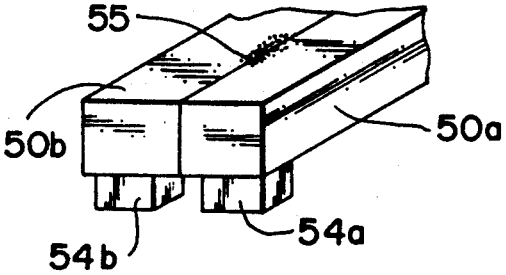
Fig - 8
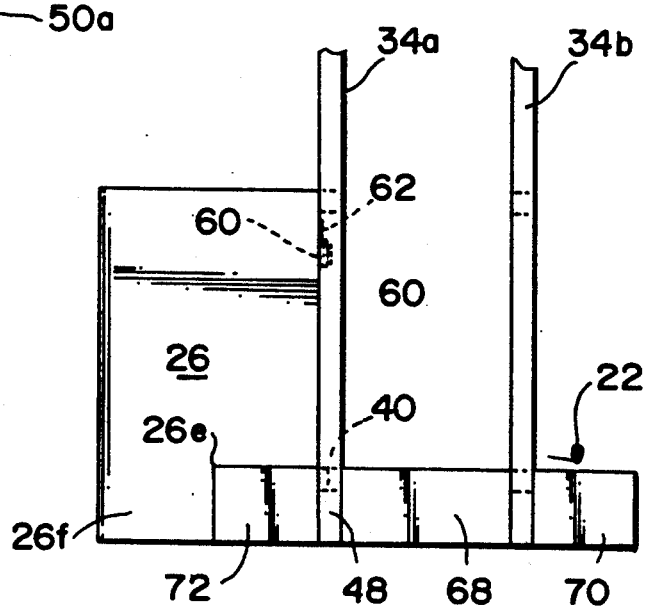

MODULAR EXHIBITRY UNIT

FIELD OF THE INVENTION

This invention concerns trade show exhibitry, for use in trade shows and conventions. It particularly relates to units which can be easily disassembled and which utilize furniture grade cabinetry and accessories.

BACKGROUND OF THE INVENTION

It is common for companies which utilize trade shows and conventions as a part of their marketing efforts to utilize custom made exhibition booths which are set up at each time of use and then disassembled and packed for shipment for subsequent use or storage. Such exhibition booths are costly to purchase and, in addition, entail considerable expenses in use to assemble and ship.

For reasons of economy, many types of light weight easily portable units have been devised. However, these easily portable units do not give an optimum visual impact of strength and solidity and cannot easily incorporate display stands, cabinets and lighting.

Exhibition contractors also have provided exhibitry for use by exhibitors. However, heretofore such exhibitry has comprised low cost tables and back drops, so called pipe-and-drape set ups, which can be readily disassembled and do not consume substantial storage space. However, such exhibitry is generally not found to be desirable by trade show exhibitors because it does not convey a favorable visual impression.

SUMMARY OF THE INVENTION

It is an object of the invention to provide trade show exhibitry which is of furniture grade quality, which provides flexibility and variation in the arrangement of elements, which is easily assembled and disassembled, and which disassembles into elements or units that can be efficiently stored in a minimum of storage space.

The invention provides disassembleable exhibition units which are capable of supporting furniture grade cabinetry and accessories. The units include a central, three dimensional support core that includes a pair of upright frames mounted in a base and held together to form the stable, three dimensional core. Cabinets, covering panels, lighting units and other accessories are detachably mounted on the central core. Electrical and other utility services can be provided to the exhibition stand through the central core.

BRIEF DESCRIPTION OF THE DRAWING

FIG. 4 is an exploded view of the joining element for joining the tops of the frames of the support core.

FIG. 4*a* is a fragmentary view of a second form of joining element;

FIG. 6 is a perspective view of a mounting element for cabinets and accessories on the support core;

FIG. 8 is a side elevational view showing the interfitting of a cabinet with the support core and base;

BRIEF DESCRIPTION OF THE PREFERRED EMBODIMENT

Figure 1:
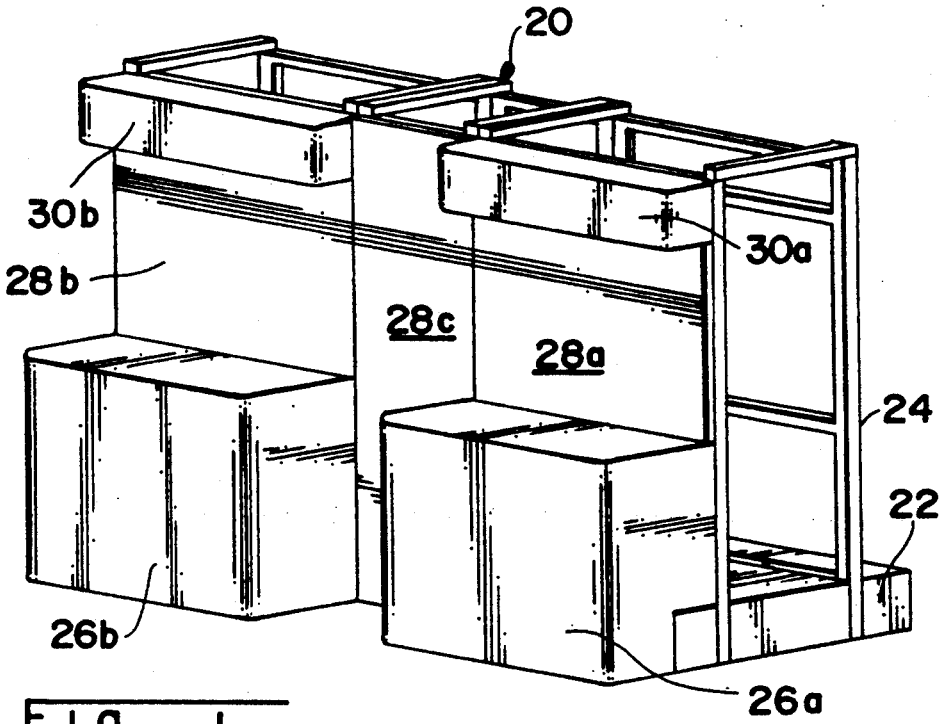
FIG. 1 is a perspective view of an assembled exhibition unit in accordance with the invention.

Referring to FIG. 1, a preferred form of disassembleable exhibition furniture unit 20 is shown. The unit includes a base 22 which supports a rigid, three dimensional support core 24, which will be described further in greater detail. The unit 20 also includes a plurality of exhibition furniture units, for example cabinet units 26*a* and 26*b* and lighting units 30*a* and 30*b* mounted on support core 24. The furniture units depicted in FIG. 1 are shown only for purposes of illustration and can comprise other units such as tables, shelves and the like. In addition, accessories such as panels 28*a*, 28*b* and 28*c* can be mounted on the core to cover the open portions of the support core and provide additional features such as, for example, computer demonstration stations, slot wall and flush mounted light boxes. An important aspect of the design is that the furniture elements and accessories are of furniture or cabinet grade quality and thus tend to be quite heavy. The base 22 and support core 24 are particularly adapted for supporting these relatively heavy units.

Figure 3:
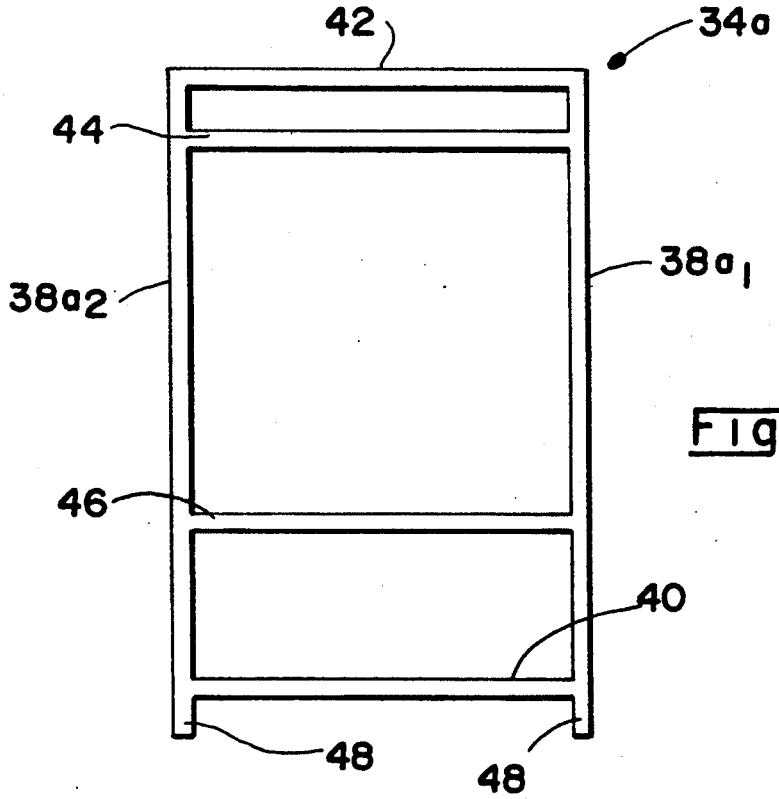
FIG. 3 is an elevational view of one of the frames forming the support core.
Figure 2:
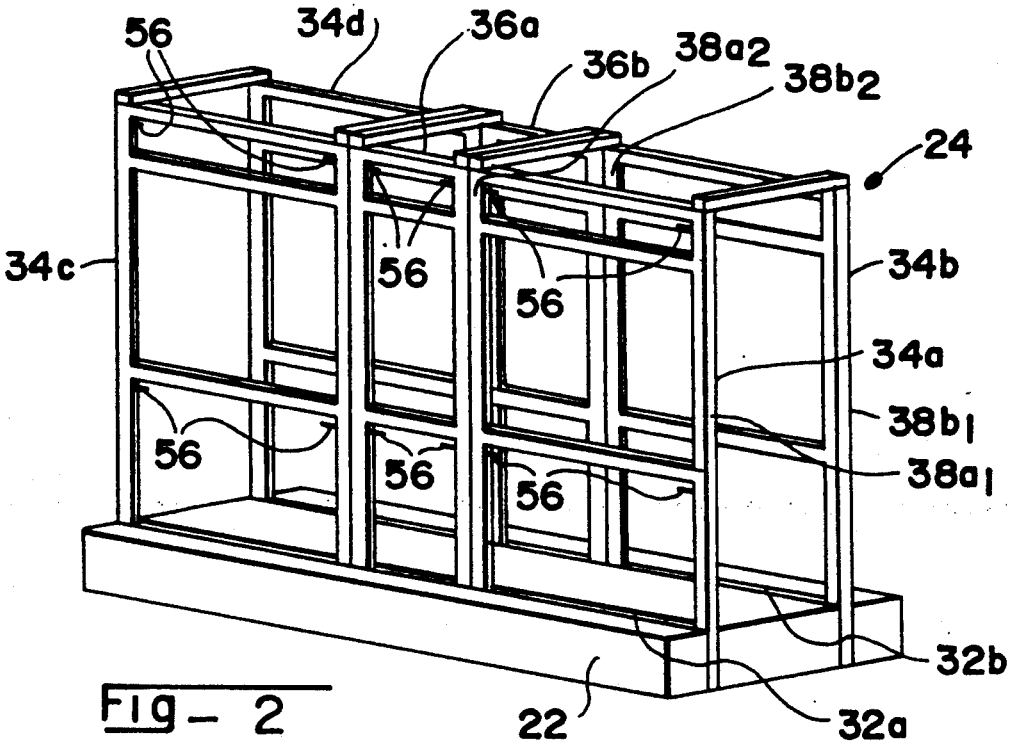
FIG. 2 is a perspective view of the central core of an exhibition unit mounted on its support base.

FIG. 2 is a perspective view of the base 22 and three dimensional rigid support core 24. The base 22 includes a pair of longitudinally extending slots 32*a* and 32*b* for receiving portions of the support core 24. As illustrated in FIG. 2, the support core 24 comprises two substantially planar, parallel, mutually spaced frames 34*a*, 34*b* made of rigid elongate members, preferably tubular and of a light weight metal, such as aluminum. An individual frame 34*a* is shown in plan view in FIG. 3. A typical frame comprises a pair of parallel, mutually spaced upright members $38a_1$ and $38a_2$. The uprights $38a_1$ and $38a_2$ are joined by a plurality of cross members such as, for example, the lower cross member 40 located adjacent the lower end of the uprights and the upper cross member 42 disposed at or near the upper end of the uprights. In addition, for added strength and stability, intermediate cross members 44 and 46 are utilized. The cross members 40, 42, 44 and 46 are joined to the uprights by suitable means, for example, welding, to produce a rigid frame.

Figure 10:
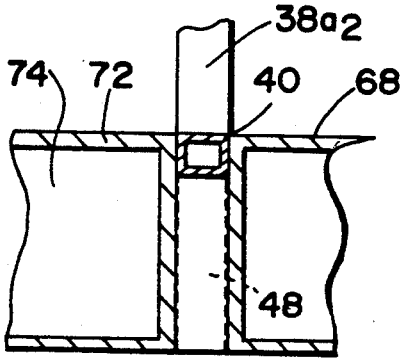
FIG. 10 is a partial cross-sectional view taken along line 10—10 of FIG. 9.

Referring into FIG. 2, frame 34*a* is placed in slot 32*a* and a similar frame 34*b* is placed in spaced, aligned, parallel relationship to the frame 34*a* in the other of the slots 32*b*. The support core 24 can comprise two aligned frames extending the entire length of the base 22 or, alternately as shown, can comprise a plurality of frames, such as frames 34*a*–34*b*, 34*c*–34*d* and 36*a*–36*b* which are held in side-by-side relationship in the slots 32*a* and 32*b* of the base. The frames 34*c*, 34*d*, 36*a* and 36*b* are generally of the same construction as frame 34*a*, but may vary in width in the longitudinal direction of base 22. The width of the slots 32*a* and 32*b* is the same and is such that the lower ends of the frames are frictionally held within the slots. In a preferred arrangement, the legs 48 are received in the slot and extend to the bottom of the base 22 (see FIG. 10). In addition, it is desirable to interrelate the placement of cross member 40 to the height of the base so that the top of the cross member is flush with the top surface of the base, again as shown in FIG. 10. Such an arrangement provides substantial vertical stability to the frame or frames received in each slot.

The tops of the frames are joined by transversely extending joining members 50, one of which is shown in FIG. 4. The joining member 50 includes an elongate body 52, preferably formed of the same material as the frames. At each end of the body 52 is a leg 54 extending at a right angle to the member 52. As previously described, the uprights $38a_1$ and $38a_2$ are tubular and, ideally, are open at their upper ends as shown in FIG. 4. The legs 54 are sized so as to enter into the ends of the tubular uprights with a close frictional fit so that each of the legs is snugly received within the openings of the uprights. Suitable joining members are provided for each aligned pair of frame uprights which are mounted in slots 32*a* and 32*b*. In this fashion, the respective frames are locked in transverse spaced relationship to form a rigid three dimensional support core. If a plurality of side by side frames are arranged in slots 32*a* and 32*b* to form the support core, as shown in FIG. 2, a modified form of joining member is utilized which aids in maintaining adjacent frames together. This joining member is shown in FIG. 4*a* and comprises a pair of transversely extending elongate bodies 50*a* and 50*b*. The bodies 50*a* and 50*b* carry, at respective ends, legs 54*a* and 54*b* of essentially the same construction as discussed with respect to the joining member shown in FIG. 4. In this arrangement, the elongate bodies 50*a* and 50*b* are joined together by suitable means, such as the weldment 55. Such a member is used to join adjacent upright members of adjacent frames, for example, frame 34*a* and frame 36*a* longitudinally, as well as join corresponding uprights of frames 34*a* and 34*b* and 36*a* and 36*b*, respectively.

Figure 5:
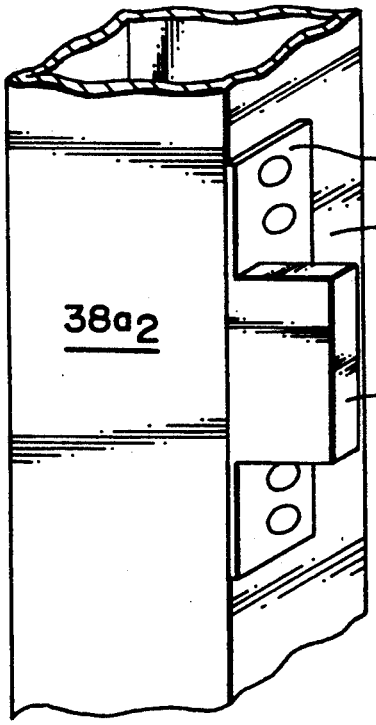
FIG. 5 is a fragmentary perspective view of a mounting member on a frame.

As shown in FIG. 2, each of the frames 34*a*, 34*c* and 36*a* includes a plurality of securing members 56, one of which is shown in FIG. 5. The securing member 56 includes a plate 58 that is secured to an interior side face of the upright on which it is mounted. The securing means can be attached to the upright by suitable means, such as screws or by welding. The plate 58 includes an upstanding tang 60 which extends toward the center of the frame. As shown in FIG. 2, a plurality of such securing members are positioned on the frames to coincide with the mounting requirements for furniture units to be mounted on the support core. All are mounted to face inwardly toward the center of the frame and preferably are positioned so that tang 60 does not extend beyond the front face of the frame.

Figure 7:
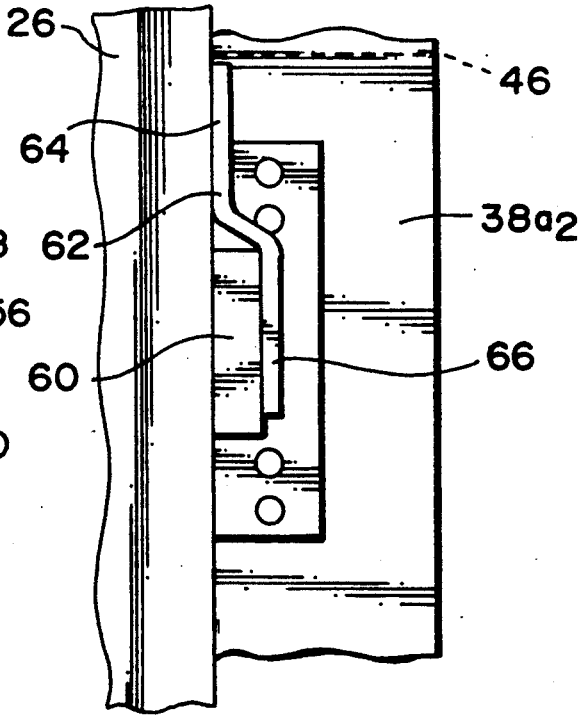
FIG. 7 is a fragmentary elevational view showing a preferred means for mounting cabinetry and accessories on a frame.

As shown in FIGS. 6 and 7, the furniture units and accessories, for example cabinet 26 in FIG. 7, have mounted on a rearwardly facing surface thereof a receiving member 62. The receiving member 62 includes a substantially planar securing section for securing the receiving member on the rear surface of a unit to be mounted on the support core. The receiving member 62 includes a tongue 66 which is displaced out of the plane of the securing section 64. As shown in FIG. 7, the receiving member 62 is mounted to receive a corresponding tang 60 as the unit is moved vertically downwardly along the front face of a frame. In this manner, the furniture units and accessories are detachably secured onto the support core 24. To enable use as a double-sided unit, frames 34*b*, 34*d* and 36*b* also include securing members 56.

FIG. 8 illustrates a furniture and base arrangement that is particularly adapted for imparting additional transverse stability to the unit. In this arrangement, a cabinet 26 has been secured onto the support core by means of the tang 60 and receiving element 62, as previously described. The furniture unit 26 is configured to have a cut out portion 26*e* which interfits with the outside portion 72 of the base 22. The furniture unit 26 is configured so that a portion 26*f* thereof extends beyond the outside portion 72 of the base and rests on the same supporting surface as the base 22. In this manner, additional lateral stability is imparted to the unit 20. In addition, the outwardly extending portion 26*f* of unit 26 covers the base and hides it from view.

Figure 9:
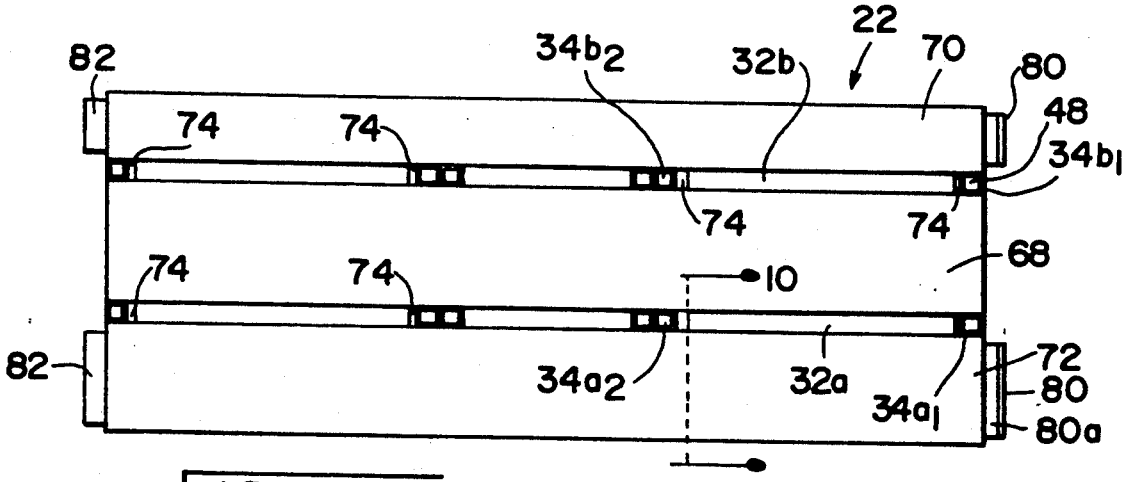
FIG. 9 is a plan view of the core-supporting base.

Referring to FIG. 9, in a preferred form, the base 22 comprises a central longitudinally extending element 68 flanked by a pair of outside, longitudinally extending base portions 70 and 72. The outside sections 70 and 72 are spaced from the central portion 68 and form the pair of longitudinally extending substantially parallel slots 32*a* and 32*b*. The portions 68, 70 and 72 are secured together by a plurality of transversely extending plates 74. This arrangement is shown in partial fragmentary cross sectional view in FIG. 10. As has been previously noted, the spacing between the outside sections 70 and 72 of the base and the central section 68 is such that the frames are frictionally received in the slots 32*a* and 32*b* formed respectively between the sections. Further, the transverse dimension of the central section 68 and the space between the depending legs 54 of the joining members 50 is essentially the same so that the frames, for example frames 34*a* and 34*b*, are held in parallel relationship. The mounting of the frames in the slots of the base and the joining of back-to-back frames by the joining members 50 result in the formation of a rigid three dimensional frame capable of supporting heavy furniture units. It also results in a structure which easily disassembles for storage.

Figure 11:
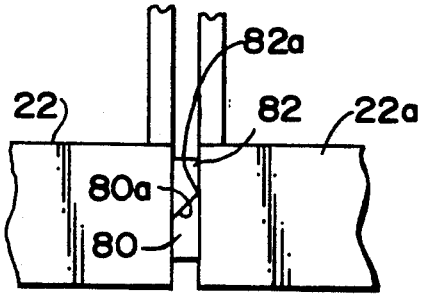
FIG. 11 is a fragmentary elevational view showing the joining of two adjacent base units.

It has also been found desirable to lock adjacent bases 22 of units of units 20 together to prevent separation of units when they are set up and to enhance stability of the units. A preferred arrangement for accomplishing this feature is shown in FIG. 11. At one end of a base member 22, a lower locking member 80 is mounted onto the end of each outside portion of the base 70 and 72 (see FIG. 9). The locking member 80 includes an upwardly facing inclined locking surface 80*a*. On an end of an outside section of an adjacent base 22*a* there is mounted an upper locking member 82 having a downwardly facing inclined locking surface 82*a*. The surfaces 80*a* and 82*a* are interrelated so as to be mutually interlocking when placed together as shown in FIG. 11. This prevents separation between the bases 22 and 22*a* while the units are erected.

Figure 12:
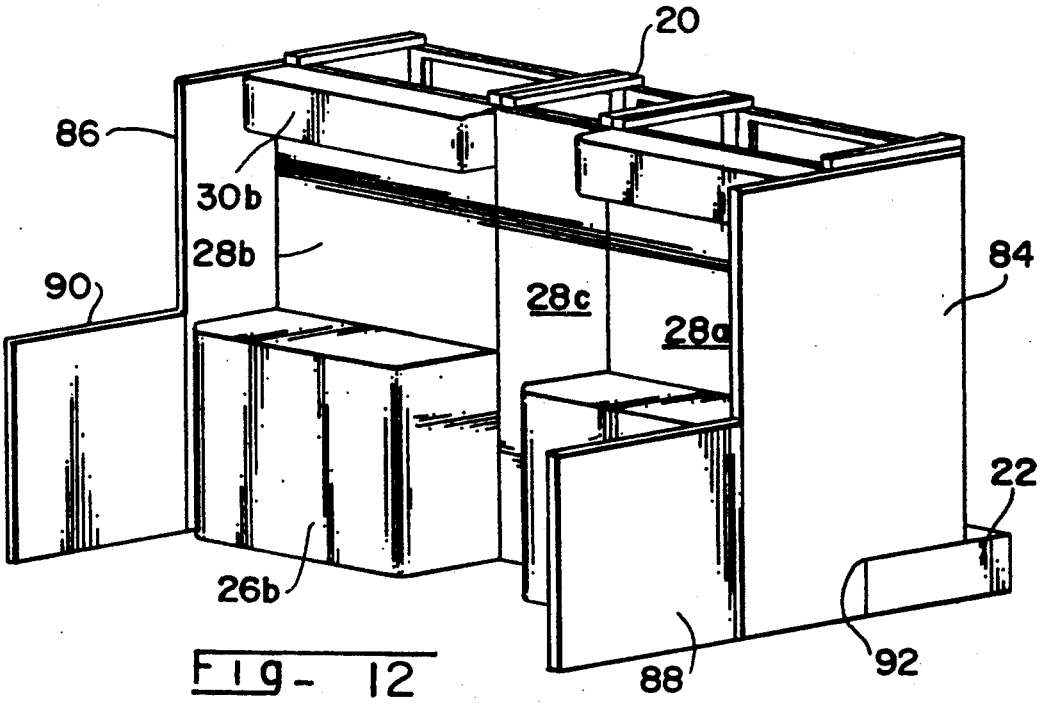
FIG. 12 is a perspective view of an assembled exhibition unit with side walls.

Referring to FIG. 12, the unit 20 can also include side walls at each end, such as side walls 84 and 86. The side walls are mounted onto the support core 24 in a manner similar to the furniture units and accessories, as previously described. That is, a plurality of securing members 56 (not shown) are mounted on the endmost uprights of the core. The end walls carry receiving elements, such as element 62 (not shown), which engage the securing members, a previously described. The end walls cover the open ends of the core, provide separation between adjacent units, and provide additional transverse stability to the units. End walls 84 and 86 are provided with a cut out portion 92 which interfits with base 22 so that the walls can be flush with the ends of base 22. The end walls 84 and 86 can also include means (not shown) for securing additional front wall sections 88 and 90 onto the end wall sections 84 and 86, respectively. One suitable means for doing so is bed hooks. In this manner, additional separation between exhibit spaces of adjacent units can be obtained.

In use, the units 20 can be assembled and disassembled readily. The frames, for example 34*a*, 34*b* are inserted into the slots 76 and 78 of the base 22 and are held upright therein by reason of the support imported by the sides of the slots 32*a* and 32*b*. The upper ends of the frames are joined together by inserting the joining members into the open ends of the respective uprights of the frames, thereby forming an upright rigid supporting arrangement comprising the base 22 and the core 24. In order to assemble the furniture units and accessories onto the support core, the units are placed against the outer surface of the frames with the receiving members positioned above the tangs 60 and allowed to slide vertically downwardly, whereby the receiving members 62 receive the tangs 60 and secure the units onto the support core. The receiving members are positioned so that the furniture units and panels fit snugly against the front surface of the frames. The units and accessories are assembled in vertical order from bottom to top by this procedure. Disassembly of the unit is in the reverse order of that just described.

This design provides substantial benefits in terms of providing a furniture unit which provides an acceptable marketing appearance. The system provides a strong rigid structure which is entirely self supporting, which can be assembled and disassembled easily and which disassembles into subunits that can be efficiently stored. In addition, by providing spacing between the frames, a space suitable for electrical service to the unit 20 is provided. In addition, it is to be noted that the construction of the preferred embodiment is substantially symmetrical about the longitudinal centerline at base 22 so that the unit can be double sided, thereby providing an exhibition stand on the opposite side of the unit.

What is claimed is:

1. An exhibition stand comprising:

a three dimensional base for resting on a support surface, the base including a central section flanked by two opposed outside sections;

a pair of upright frames, each frame comprising:

two opposed, spaced upright tubular members forming respective sides of the frame;

a lower member extending between the opposed upright members; and an upper member extending between the opposed upright members;

means on the base for receiving a lower portion of each frame to detachably mount the frames in spaced, opposed upright positions, with each of the frames being disposed between the central section and one of the outside sections;

means for joining the frames together, the joining means being located at a position spaced from the base, said joining means comprising a pair of U-shaped joining members, each joining member having an elongate central portion and a leg extending angularly at each end of the central portion, each leg including means for interfitting with one of said tubular upright members;

a first furniture element;

means for detachably fixing the furniture element on one of the frames;

a second furniture element;

means for detachably fixing the second furniture element on said one frame at a location above the first furniture element;

a panel of a size to extend from the first element to the second element; and means for detachably mounting said panel on said one frame between the first and second furniture elements.

2. Apparatus as in claim 1, wherein the central section of the base includes opposed side surfaces, and each side section of the base includes a side surface opposed to one of the side surfaces of the central section;

said side surfaces of the central section and said side surfaces of each outside section being configured to frictionally receive the lower portion of each of the frames between said respective side surfaces of the central section and the outside sections.

3. Apparatus as in claim 1, wherein the joining means comprises:

a first transverse member for detachably joining one of the upright members of a first of the frames to one of the upright members of a second of the frames and a second transverse member for detachably joining a second of the uprights of the first frame with a second of the uprights of the second frame.

4. Apparatus as in claim 1, wherein the first furniture element includes a cut out portion for interfitting with one of said outside sections of the base and a portion extending transversely beyond the side portion of the base.

5. Apparatus as in claim 4, wherein the interfitting portion covers one of the outside sections of said base and is dimensioned to extend to a support surface on which the base rests.

6. Apparatus as in claim 1, wherein the interfitting means comprise a section of each leg adapted to be received within one of said tubular upright members.

7. A disassembleable exhibition unit comprising:

a three dimensional base, the base including a central section flanked by two opposed outside sections;

a three dimensional open support core, the support core comprising a pair of support frames, each frame having at least two tubular upright members and at least two transverse members extending between said upright members, and joining members for detachably joining the two frames together in spaced, substantially parallel relationship at a location spaced from the base, said joining means comprising a pair of U-shaped joining members, each joining member having an elongate central portion and a leg extending angularly at each end of the central portion, each leg including means for interfitting with one of said tubular upright members;

means on the base for removably receiving a lower portion of each of the pair of frames and supporting the frames in an upright, spaced relationship with one of the frames on each side of the central section of the base to present at least one exterior face;

a plurality of furniture units adapted to be mounted on said exterior face of the support core; and means for detachably mounting the furniture units on said support core.

8. Apparatus as in claim 7, wherein the frames are substantially planar.

9. Apparatus as in claim 8, wherein the transverse members of the frames are tubular.

10. Apparatus as in claim 7, wherein the base comprises an elongate body and a pair of parallel slots extending parallel to the longitudinal axis of the body, each slot being adapted to receive the lower portion of one of the frames of the core.

11. Apparatus as in claim 7, wherein the base includes locking means for locking the base to an adjacent base.

12. An exhibition stand comprising:

a base for resting on a support surface;

a pair of upright frames, each frame comprising:

two opposed, spaced, tubular upright members forming respective sides of the frame;

a lower member extending between the opposed upright members; and an upper member extending between the opposed upright members;

means on the base for detachably mounting the frames in spaced, opposed upright positions;

joining means for joining the frames together at a position spaced from the base, said joining means comprising a pair of U-shaped joining members, each joining member having an elongate central portion and a leg extending angularly at each end of the central portion, each leg including means for interfitting with one of said tubular upright members;

a first furniture element;

means for detachably fixing the furniture element on one of the frames;

a second furniture element;

means for detachably fixing the second furniture element on said one frame at a location above the first furniture element;

a panel of a size to extend from the first element to the second element; and means for detachably mounting said panel on said one frame between the first and second furniture elements.

13. Apparatus as in claim 12, wherein the interfitting means comprise a section of each leg adapted to be received within one of said tubular upright members.

14. Apparatus as in claim 12, wherein said base comprises a central longitudinally extending section having opposed side surfaces, a pair of outside sections extending longitudinally in flanking relationship to the central section, each outside section having a side surface opposed to one of the side surfaces of the central section;

said side surfaces of the central section and said side surfaces of each outside section being configured to frictionally receive the lower portion of each of the frames between said respective side surfaces of the central section and the outside sections.

15. Apparatus as in claim 12, wherein a first one of the pair of joining members detachably joins one of the upright members of a first of the frames to one of the upright members of a second of the frames and a second one of the pair of joining members detachably joins a second of the uprights of the first frame with a second of the uprights of the second frame.

16. Apparatus as in claim 12, wherein the first furniture element includes a cut out portion along a rearward portion thereof for interfitting with said base and a portion for extending transversely outwardly from the base.

17. Apparatus as in claim 16, wherein the interfitting portion covers an outside portion of said base and is dimensioned to extend to a support surface for the base.

* * * * *